US006790117B2

(12) United States Patent
Ruiz Gonzalez

(10) Patent No.: US 6,790,117 B2
(45) Date of Patent: Sep. 14, 2004

(54) COMPOSITION TOY

(76) Inventor: María Teresa Ruiz Gonzalez, C/Francia no. 21 Bajo, Vitoria, Gasteiz, Alava (ES)

( * ) Notice: Subject to any disclaimer, the term of this patent is extended or adjusted under 35 U.S.C. 154(b) by 0 days.

(21) Appl. No.: 10/383,284

(22) Filed: Mar. 6, 2003

(65) Prior Publication Data

US 2003/0171062 A1 Sep. 11, 2003

(30) Foreign Application Priority Data

Mar. 8, 2002 (ES) ..... 200200587

(51) Int. Cl.[7] ..... A63H 33/04
(52) U.S. Cl. ..... 446/92; 446/98; 446/139
(58) Field of Search ..... 446/92, 97, 98, 446/99, 100, 101, 129, 137, 138, 139, 387, 388, 901

(56) References Cited

U.S. PATENT DOCUMENTS

| | | | | | |
|---|---|---|---|---|---|
| 2,027,352 | A | | 1/1936 | Wessberg | 46/157 |
| 2,331,776 | A | | 10/1943 | Heggedal | 46/157 |
| 2,363,914 | A | | 11/1944 | Wakefield | 46/157 |
| 2,987,831 | A | | 6/1961 | Stepat et al. | 35/56 |
| 3,316,669 | A | * | 5/1967 | Nachbar | |
| 3,783,554 | A | * | 1/1974 | Shapero | |
| 4,038,775 | A | * | 8/1977 | Sato | |
| 4,238,905 | A | * | 12/1980 | MacGraw, II | |
| 4,925,423 | A | * | 5/1990 | Miller et al. | 446/98 |
| 5,022,886 | A | | 6/1991 | Jenkins | 446/268 |
| 5,127,652 | A | * | 7/1992 | Unger | 273/157 R |
| 5,178,573 | A | | 1/1993 | Smith | 446/73 |
| 5,405,465 | A | * | 4/1995 | Horiuchi | 156/73.1 |
| 5,409,236 | A | * | 4/1995 | Therrien | 273/288 |
| 5,746,638 | A | * | 5/1998 | Shiraishi | 446/92 |
| 5,906,530 | A | * | 5/1999 | Lindsey | 446/85 |
| 6,010,387 | A | | 1/2000 | Nemec et al. | 446/327 |
| 6,062,937 | A | * | 5/2000 | Kikuchi | 446/91 |
| 6,511,360 | B1 | * | 1/2003 | Lyman | 446/325 |

FOREIGN PATENT DOCUMENTS

EP 1 095 683 A2 5/2001

* cited by examiner

*Primary Examiner*—Derris H. Banks
*Assistant Examiner*—Ali Abdelwahed
(74) *Attorney, Agent, or Firm*—Ostrolenk, Faber, Gerb & Soffen, LLP

(57) ABSTRACT

Composition toy including at least one main template, e.g. a body shape and at least one secondary template, e.g. clothing. The main template is provided with first magnetic attraction elements and the secondary template is provided with second attraction elements. The first and the second attraction elements are configured in order to determine a magnetic attraction between the main and secondary templates. The attraction elements are placed at specific points on the templates which orient the templates to each other.

6 Claims, 5 Drawing Sheets

COMPOSITION TOY

FIELD OF THE INVENTION

The invention relates to a composition toy of the type comprised of a main template, which can represent a human figure, and one or more secondary templates that can represent clothing items and/or complements that can be added onto the main template.

BACKGROUND OF THE INVENTION

US Patents such as U.S. Pat. Nos. 6,010,387, 5,022,886, 2,331,776 and 2,027,352 disclose various examples of composition toys or the like in which the secondary templates are coupled to the main templates by various mechanical union means.

U.S. Pat. No. 2,987,831 does not exactly relate to a composition toy, but instead to a teaching aid including a number of figures shown in a line to which can be coupled boards or the like representing clothes. In one embodiment described in this patent, the figures and boards are attached by elements fixed to the figures and boards which attract each other magnetically (such as permanent magnets on the figures and iron elements on the boards; it describes that the magnets and iron elements can be housed in recesses and held with adhesive tape).

However, U.S. Pat. No. 5,178,573 describes a composition toy including various templates that can be magnetically coupled to each other, as they are made of either a magnetic or a ferromagnetic material.

Spanish application for Utility Model 9902740 describes a composition toy with main templates (that can represent persons) and secondary templates (that can represent clothing items) including magnetic or ferromagnetic particles so that the templates are coupled to each other by magnetic attraction.

The systems described in U.S. Pat. No. 5,178,573 and in the Spanish application for Utility Model 9902740 can work well as long as there is a magnetic attraction between the main and secondary templates; this is, as long as the templates simply remain adhered to each other. However, it is often not enough that the secondary templates remain magnetically adhered to the main template, as the relative position of these templates may be important. For example, when the main template represents a human figure (or the outline of a human figure, as these are essentially two-dimensional figures, with a small thickness) and the secondary template represents a clothing item it may be of interest to place the clothing item in a give position corresponding to that which the item would be in when worn by a real person. Unfortunately, the systems described in U.S. Pat. No. 5,178,573 and the Spanish application for Utility Model 9902740 do not provide means to maintain the secondary templates at a given position with respect to the main template; both antecedents seem to propose systems based on templates with magnetic or ferromagnetic characteristics located uniformly throughout the templates, so that once the secondary templates have been placed on the main templates it is likely that one may slide on the other.

DESCRIPTION OF THE INVENTION

The toy is comprised of at least one main template and at least one secondary template. The main template is provided with a first means of attraction of the secondary template and the secondary template is provided with a second means of attraction of the main template. The first means of attraction and the second means of attraction are configured in order to establish a magnetic attraction between the main template and the secondary template.

According to the invention, the first means of attraction comprise a plurality of first attraction elements located at certain points of the main template, and the second means of attraction comprise a plurality of second attraction elements located at certain points of the secondary template. These certain points of the main template and the secondary template are located such that when the secondary template is superposed on the main template, the second attraction elements are near corresponding first attraction elements. In this way, the secondary template and the main template are coupled to each other by a magnetic attraction between the first attraction elements and the second attraction elements.

These certain or specific points are important: in some of the previously described antecedents, the templates of the composition toy are made of a magnetic material or a material that can be attracted by magnets (such as iron). In this way, there is an attraction between the templates but it is not ensured in any way that one template will maintain a specific orientation or positioning with respect to the other. However, in accordance with the invention, by placing attraction elements at specific points of the templates, certain specific points of the secondary template can be attracted to specific points of the main template.

This is particularly of interest in a preferred embodiment of the invention, wherein the main template is flat or essentially flat and its outline represents that of a human figure. The toy can include one or preferably several secondary templates representing clothing items, which can also be flat or essentially flat. According to the invention, specific points of the clothing items are attracted by specific points of the human figure, so that a correct positioning is achieved of the clothing items, thereby preventing the items from being placed incorrectly or anaesthetically.

The first and/or second attraction elements must include some form of magnet, but it is not necessary for all the attraction elements to include magnets; for example, some (the first attraction elements or the second attraction elements) can include magnets while the others (the second attraction elements or the first attraction elements) can include another material that can be attracted by a magnet (such as soft iron, some types of steel, etc.). In this descriptive memory, the term "magnet" refers to any material that can attract magnetically other materials such as, for example, iron.

The first attraction elements are placed inside the main template and the second attraction elements are placed inside the secondary template, so that they are not accessible directly from the outside. This means that the invention is particularly well suited for children, reducing the risk that the attraction elements are separated from the templates; in addition, this improves the appearance of the invention, as the attraction elements can be concealed under the surface of the templates.

The first attraction elements can be housed in orifices of the main template. These orifices can be non-passing, this is, they correspond to recesses in one of the faces of a base part of the template, being covered by a front part or a dorsal part of the main template. Alternately, the first attraction elements can be housed in orifices passing through one of the central parts of the main template, these orifices being covered by a front part and a dorsal part of the main template.

The second attraction elements can be housed in orifices of the secondary template. These orifices can be non-passing, this is, they correspond to recesses in one of the faces of a base part of the template, being covered by a front part or a dorsal part of the main template. Alternately, the second attraction elements can be housed in orifices passing through one of the central parts of the secondary template, these orifices being covered by a front part and a dorsal part of the main template.

The first and second attraction elements can have similar configurations, such as circular, but they do not have to be identical.

When the main template represents a human figure and/or has the outline of a human figure, the first attraction elements can be placed on points corresponding to the chest, hips and feet of said figure. For example, in the case of a female figure the first attraction elements can include two attraction elements placed in the area of the breasts, two attraction elements placed in the area of the hips or pubic area, and one attraction element placed in each of the feet. Additionally, it may be convenient to place attraction elements at the areas of the elbows and/or shoulders of the figure.

The templates can be made, for example, of plastic and/or cardboard.

BRIEF DESCRIPTION OF THE DRAWINGS

A brief description is now made of a set of drawings meant to aid a better understanding of the invention and that are directly related to two possible embodiments of the invention, shown for purposes of illustration and in a non-limiting sense.

DESCRIPTION OF TWO PREFERRED EMBODIMENTS OF THE INVENTION

Figure 1:
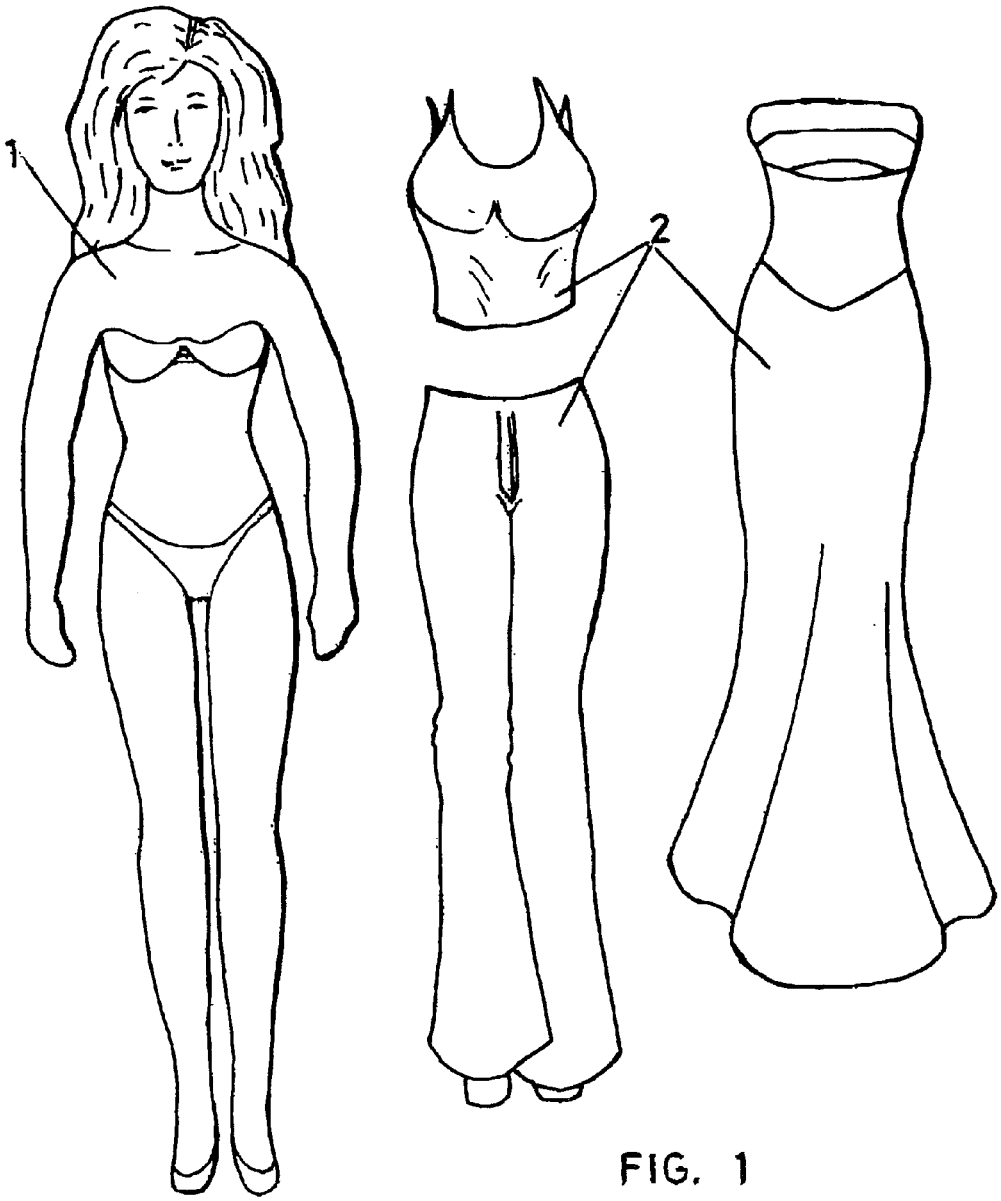
FIG. 1 is a general view of the invention, showing one main template and three secondary templates.

FIG. 1 shows a main template (1) and three secondary templates (2) according to a preferred embodiment of the invention. The main template is provided with first means of attraction of the secondary template and the secondary template is provided with second means of attraction of the main template. The first means of attraction and the second means of attraction are configured to establish a magnetic attraction between said main template and said secondary template.

Figure 2:
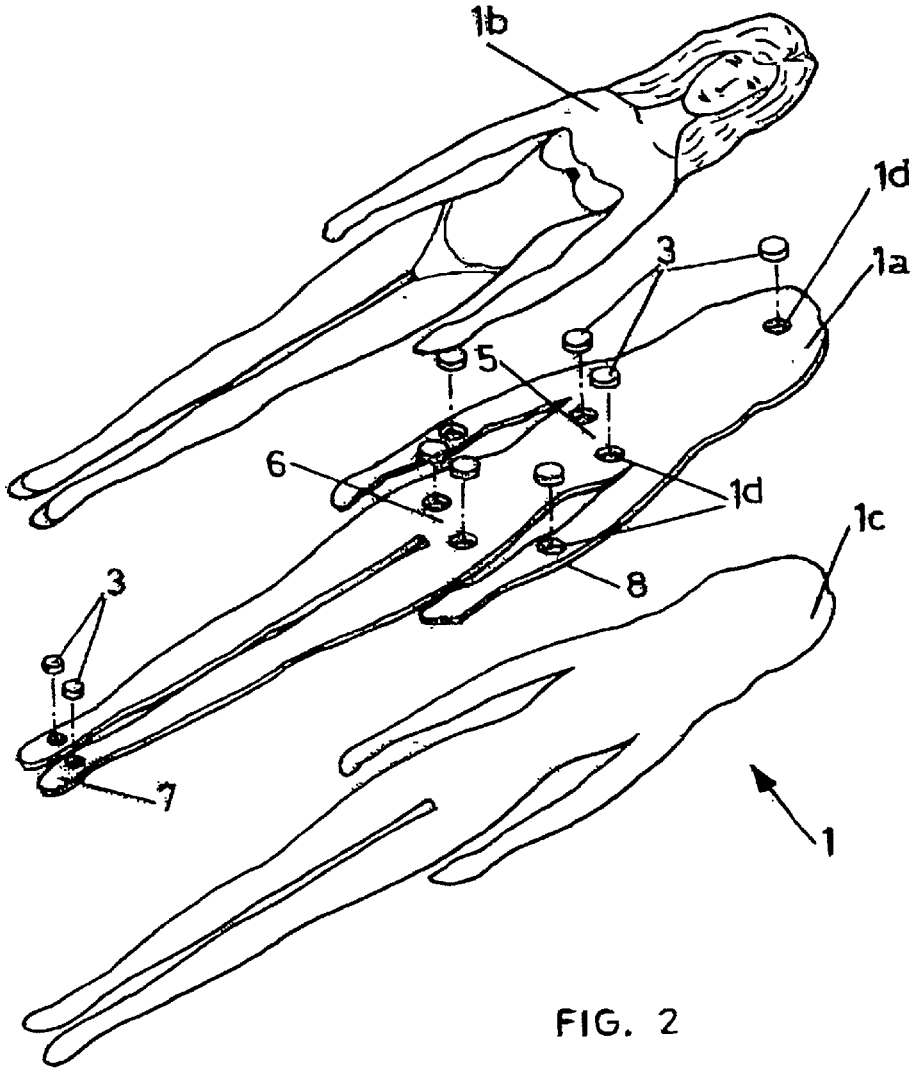
FIG. 2 is an exploded view of the main template according to a first preferred embodiment of the invention.
Figure 3:
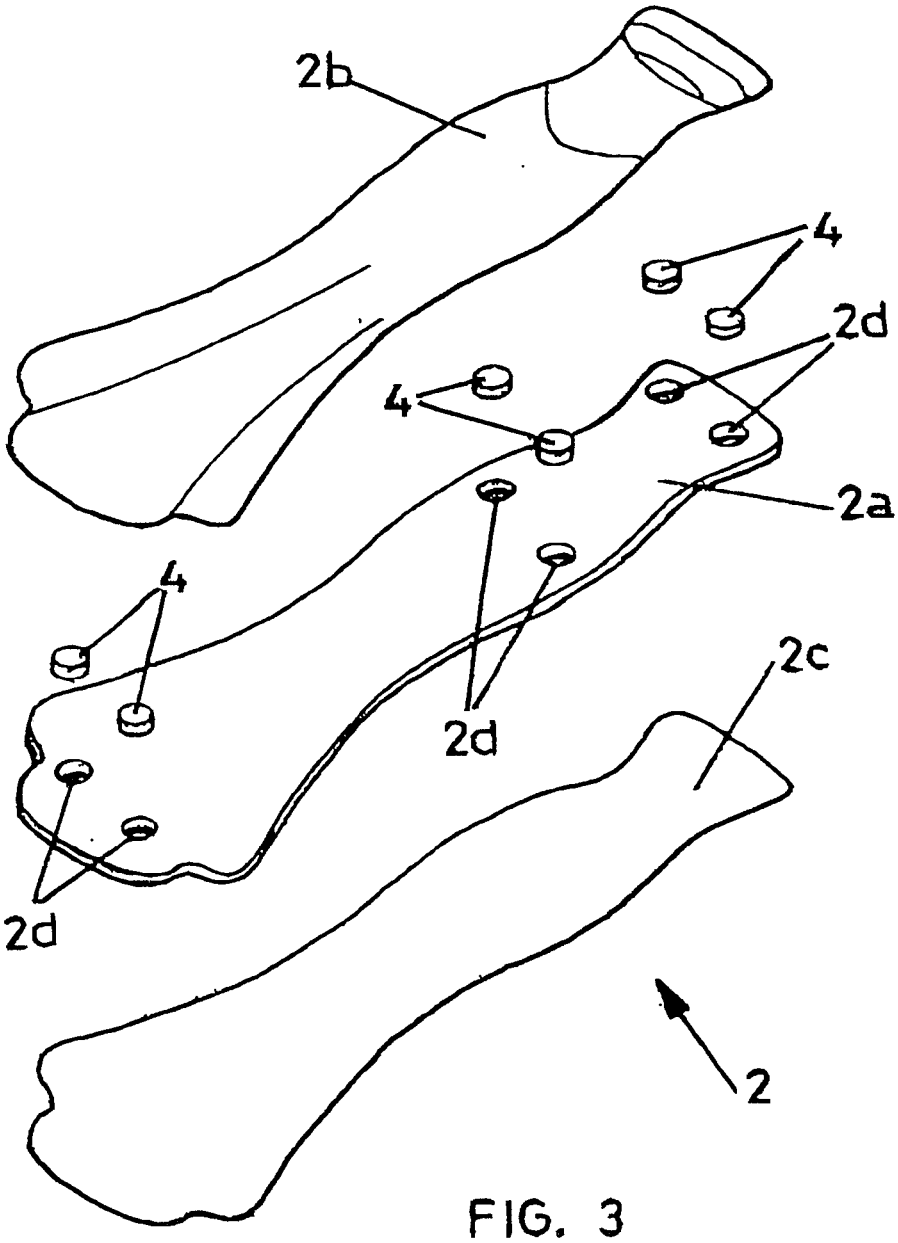
FIG. 3 is an exploded view of a secondary template according to a first preferred embodiment of the invention.

FIG. 2 shows an exploded view of the main template (1) and FIG. 3 shows an exploded view of the secondary template (2). As rendered in the drawing and according to this preferred embodiment of the invention, the main template (1) is comprised of a central part (1*a*) made of cardboard or plastic, a front part (1*b*) that comprises a thin sheet of plastic (or paper or cardboard, optionally laminated) representing facial and bodily features of a female person, and a dorsal part (1*c*) comprised of a thin sheet of paper, plastic or cardboard, optionally laminated.

The central part (1*a*), which is preferably between 0.5 and 2 mm thick, is provided with a number of through orifices (1*d*) in which are housed the first attraction elements (3). As shown, these first attraction elements (3) are placed at points corresponding to the chest (5), hips (6) or pubic area, feet (7) and elbows (8) of the figure.

Similarly, the secondary template (2) is comprised of a central part (2*a*) made of cardboard or plastic, a front part (2*b*) that is comprised of a thin sheet of plastic (or paper or cardboard, optionally laminated) representing the structure (colours, shadows, folds or patterns) of a clothing item or complement, and a rear part (2*c*) comprised of a thin sheet of paper, plastic or cardboard, optionally laminated.

The central part (2*a*), which is preferably between 0.5 and 2 mm thick, is provided with a number of through orifices (2*d*) in which are housed the second attraction elements (4).

Therefore, both the first (3) and second (4) attraction elements are housed inside the corresponding templates, concealed by the corresponding front (1*b*, 2*b*) and dorsal (1*c*) or rear (2*c*) parts.

The first attraction elements (3) and the second attraction elements (4) are circular in shape. The attraction elements are made of materials chosen such that there is a magnetic attraction between the first attraction elements (3) and the second attraction elements (4); both groups can include magnets or one can include magnets and the other elements of a material that is attracted by a magnet.

As described above, when a secondary template (2) is superposed on a main template (1) the second attraction elements (4) are placed near corresponding first attraction elements (3) and the two templates are attached by magnetic attraction in the desired relative positions.

In this embodiment, the orifices (1*d*, 2*d*) are through orifices.

It is also possible to use non-passing orifices, that is, "recesses" established in the front or dorsal face of one base of the templates. In this case, the template would not require the three layers shown in FIGS. 2 and 3 but instead only two layers, one corresponding to the base part (containing the orifices) and another corresponding to the part covering the orifices.

Figure 4:
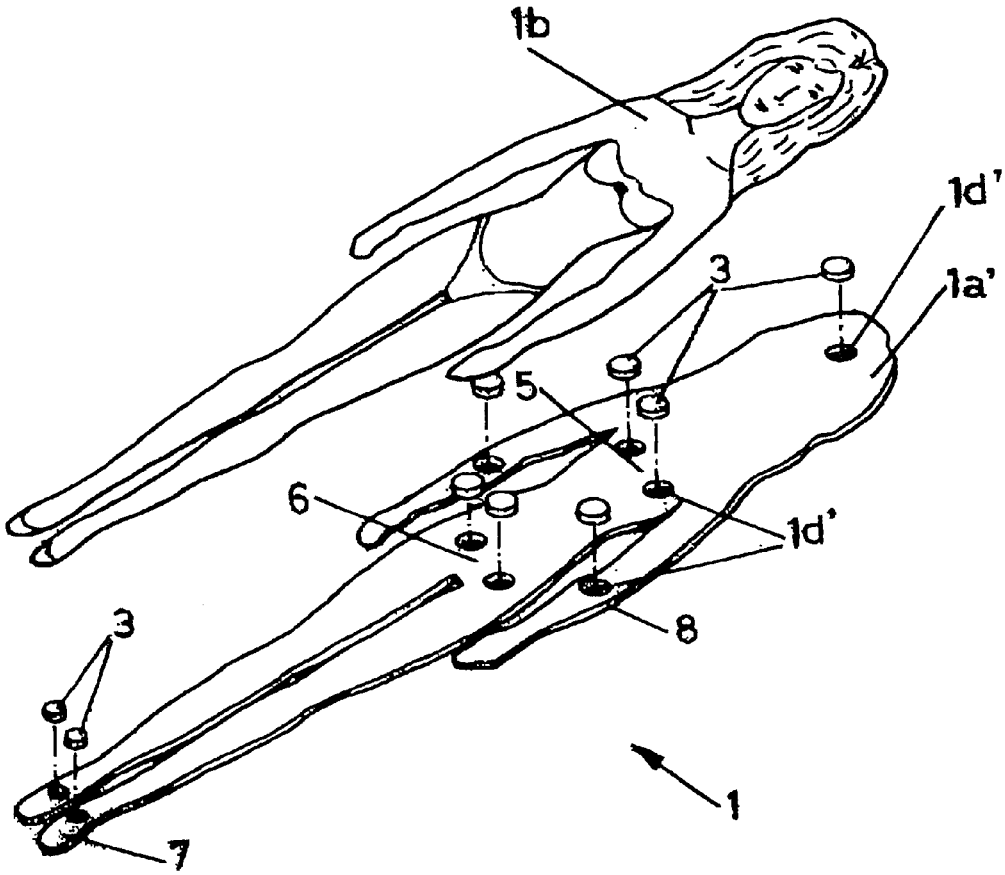
FIG. 4 is an exploded view of a main template according to a second preferred embodiment of the invention.
Figure 5:
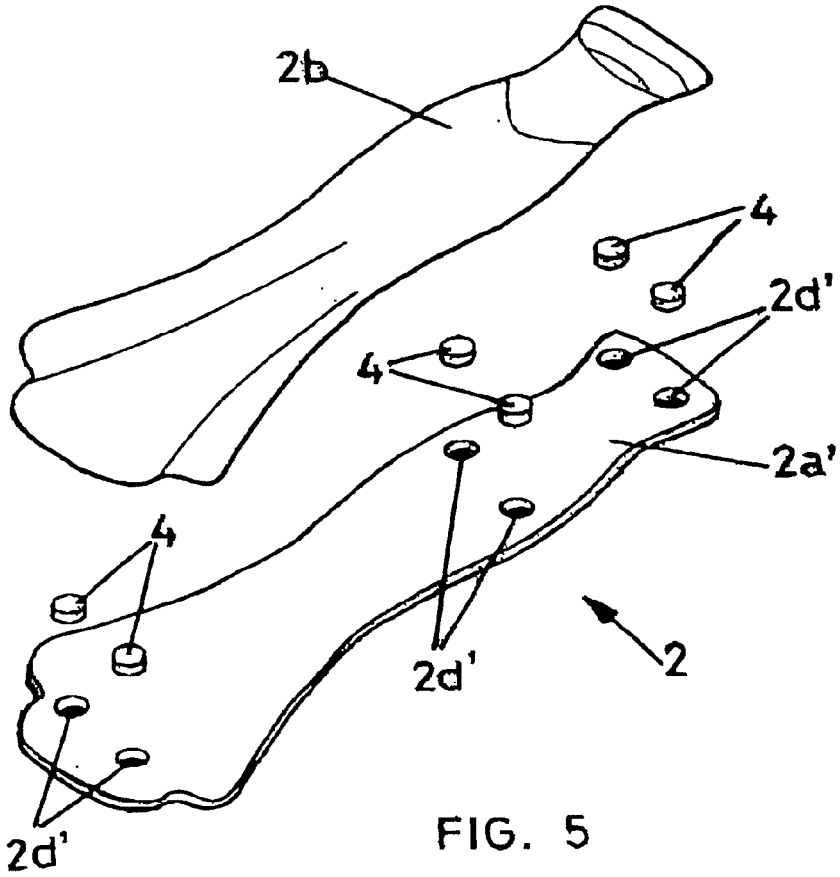
FIG. 5 is an exploded view of a secondary template according to a second preferred embodiment of the invention.

A second preferred embodiment of the invention with this alternative concept is shown in FIGS. 4 and 5.

FIG. 4 shows how the first attraction elements (3) are housed in non-passing orifices (1*d*') made in a base part (1*a*') of the main template (1), these orifices being covered by a front part (1*b*) of the main template. In an alternative embodiment, the non-passing orifices can be made in the dorsal face of the base (1*a*'), in which case they can be covered by a dorsal part (1*c*) of the main template.

FIG. 5 shows how the second attraction elements (4) are housed in non-passing orifices (2*d*') in a base part (2*a*') of the secondary template (2), these orifices being covered by a front part (2*b*) of the secondary template. In an alternative embodiment, the non-passing orifices can be made in the rear face of the base (2*a*'), in which case they can be covered by a rear part (2*c*) of the secondary template.

The materials, size, shape and arrangement of the components may vary, as long as the basic concept of the invention is not altered.

Throughout the present description and claims, the terms "comprises" and derivatives such as "comprised of" do not exclude other steps or components.

What is claimed is:

1. Composition toy comprised of: at least one main template representing a human figure; the main template has a base part and a front part over the base part; non-passing orifices in the base part; at least one secondary template;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements are housed in the non-passing orifices in the base part of the main template and the orifices are covered by the front part of the main template; and the second attraction elements being placed inside the secondary template so that they cannot be accessed from outside the secondary template.

2. Composition toy, comprised of:

at least one main template representing a human figure; the main template has a base part and a dorsal part; non-passing orifices in the base part;

at least one secondary template;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements are housed in the non-passing orifices in the base part of the main template; and the dorsal part of the main template covering the and the second attraction elements being placed inside the secondary template so that they cannot be accessed from outside the secondary the template.

3. Composition toy, comprised of:

at least one main template representing a human figure; the main template has a central part, a dorsal part behind the central part and a front part over the central part; passing orifices in the central part;

at least one secondary template;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements are housed in the passing orifices in the central part of the main template, the passing orifices being covered by the front part and by the dorsal part of the main and the second attraction elements being placed inside the secondary template so that they cannot be accessed from outside the secondary template.

4. Composition toy, comprised of:

at least one main template representing a human figure;

at least one secondary template: the secondary template has a base part, and a front part over the base part; non-passing orifices in the base part;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements being placed inside the main template the second attraction elements are housed in the non-passing orifices in the base part of the secondary template and the orifices are covered by the front part of the secondary template so that they cannot be accessed from outside the secondary template.

5. Composition toy, comprised of:

at least one main template representing a human figure;

at least one secondary template: the secondary template has a base part and a rear part; non-passing orifices in the base part;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements being placed inside the main template and the second attraction elements are housed in the non-passing orifices in the base part of the secondary templates, the orifices are covered by the rear part of the secondary template so that they cannot be accessed from outside the secondary template.

6. Composition toy, comprised of:

at least one main template representing a human figure;

at least one secondary template: the secondary template has a central part, a rear part behind the central part and a front part over the central part; passing orifices in the central part;

the main template being provided with first means of attraction of the secondary template and the secondary template being provided with second means of attraction of the main template, the first means of attraction and the second means of attraction being configured so that they establish a magnetic attraction between the main template and the secondary template;

the first means of attraction comprise a plurality of first attraction elements placed at first specific points of the main template, the second means of attraction comprise a plurality of second attraction elements placed at second specific points of the secondary template, the first specific points of the main template and the second specific points of the secondary template being placed such that when the secondary template is superposed over the main template, the second attraction elements are near corresponding ones of the first attraction elements, so that the secondary template and the main template are coupled to each other by magnetic attraction between the first attraction elements and the second attraction elements;

the first attraction elements being placed inside the main template and the second attraction elements are housed in the passing orifices in the central part of the secondary template the orifices being covered by the front part and the rear part of the secondary template so that they cannot be accessed from outside the secondary template.

* * * * *